US006092941A

United States Patent [19]

Imai

[11] Patent Number: 6,092,941

[45] Date of Patent: Jul. 25, 2000

[54] PRINTER WITH A MANUALLY OPERABLE PRINT HEAD THAT IS DETACHABLE FROM THE MAIN PRINTER BODY

[75] Inventor: Masaaki Imai, Kasugai, Japan

[73] Assignee: Brother Kogyo Kabushiki Kaisha, Nagoya, Japan

[21] Appl. No.: 09/139,024

[22] Filed: Aug. 24, 1998

[30] Foreign Application Priority Data

Aug. 26, 1997 [JP] Japan ..... 9-229537

[51] Int. Cl.[7] ..... B41J 3/36

[52] U.S. Cl. ..... 400/88

[58] Field of Search ..... 400/357, 279, 400/283, 88; 395/109–119

[56] References Cited

U.S. PATENT DOCUMENTS

| | | | |
|---|---|---|---|
| 5,825,995 | 10/1998 | Wiklof et al. | 395/117 |
| 5,848,849 | 12/1998 | Kishi et al. | 400/88 |
| 5,853,251 | 12/1998 | Imai | 400/88 |
| 5,988,900 | 11/1999 | Bobry | 400/88 |

FOREIGN PATENT DOCUMENTS

| | | |
|---|---|---|
| 63-129775 | 6/1988 | Japan . |
| Y2-8-1096 | 1/1996 | Japan . |
| 11-69100 | 3/1999 | Japan . |
| 2 012 088 | 3/1999 | United Kingdom . |

*Primary Examiner*—John S. Hilten
*Assistant Examiner*—Charles H. Nolan, Jr.
*Attorney, Agent, or Firm*—Oliff & Berridge, PLC

[57] ABSTRACT

The present invention provides an image forming apparatus that can be used not only as a normal printing device wherein images are formed on a print medium fed automatically by a feeding mechanism, but also as a manual printing device whereby an image can be formed on a print object that cannot be fed by the feeding mechanism. In the inventive image forming apparatus, when a print head is mounted on a carriage driven back and forth in a body case of the apparatus, the apparatus functions as a normal printing device. Control signals from a central control unit and electric power from a power source is sent or supplied to the print head via a cable that is flexible and long enough to allow the print head to be operated manually outside the body case of the apparatus. The apparatus may further include a guide having a longitudinal opening for receiving the print head, whereby not only the manual printing is facilitated but also the quality of the manual printing is enhanced.

22 Claims, 5 Drawing Sheets

PRINTER WITH A MANUALLY OPERABLE PRINT HEAD THAT IS DETACHABLE FROM THE MAIN PRINTER BODY

The present invention relates to an image forming apparatus wherein an image is formed, or printed, on a print medium such as paper, by mechanically conveying a print head mounted on a carriage in the direction vertical to that of feeding the print medium by a feeder. The present invention also relates to a manually movable image forming apparatus with which an image can be formed on a surface of an object by manually moving the apparatus in a preset scanning direction with its print head contacting the surface of the object.

In this specification, an object on which an image is printed is referred to as "print medium" when the object is fed by the feeder, and the object is otherwise referred to as "print object". It should be noted that an object that is not sheet-like is included in the print object so long as it has a surface on which an image is printable.

BACKGROUND OF THE INVENTION

The Publication No. S63-129775 of the Japanese Unexamined Patent Application discloses an image forming apparatus designed to be operated manually. The image forming apparatus has a manually movable housing having a thermal print head protruding downward from its bottom. In the housing are provided an ink film holder for holding a roll of thermosensitive ink film and a film winder for winding a used part of the ink film. When the housing is manually moved on a surface of a print object, the ink film is fed from the ink film holder past a heating part of the print head, while the heating elements in the heating part are driven according to a dot pattern of an image data with respect to the amount of movement of the housing.

The Publication No. H8-1096 of the Japanese Examined Utility Model Application discloses another image forming apparatus using a manually movable housing having a wire dot type of print head. In the housing are provided a film-feeding roller for holding an ink donor film and a film winder for winding a used part of the ink donor film. When the housing is manually moved on a surface of a print object, the ink donor film is fed from the film-feeding roller past the print head, and the wires of the print head are driven to strike the ink donor film according to a dot pattern of image data with respect to the amount of movement of the housing.

The above-described image forming apparatuses have the following drawbacks. First, a supplemental device is necessary for the input and storage of image data. Second, when a user intends to form images on a number of sheets of print media, for example, the user has to carry out time-consuming work including steps of securing a sheet of print medium by hand or by other means on the desk or the like, and moving the housing manually on the print medium. In such a case, it is recommended to use another type of image forming apparatus wherein a print head is mechanically driven back and forth in the direction vertical to a feed path into which a feeding mechanism feeds the print medium, one sheet after another, past the print head from a stack of print media. This type of image forming apparatus, however, cannot be used when the user intends to form an image on a medium or object that is too thick and/or stiff to be fed by the feeding mechanism.

SUMMARY OF THE INVENTION

For solving the above problem, the present invention provides an image forming apparatus that can be used not only as a normal printing device wherein images are formed on a print medium fed automatically by a feeding mechanism, but also as a manual printing device whereby an image can be formed on a print object that cannot be fed by the feeding mechanism.

Thus, the present invention proposes an image forming apparatus, including:

a print head for forming an image on a surface of an object;

a carriage for mounting the print head in a body case, where the print head is dismountable from the carriage;

a feeder for feeding the print medium in a feeding direction;

a carriage driver for driving the carriage in a main scanning direction which is vertical to the feeding direction so that the carriage scans the surface of the print medium; and a remote controller provided in the body case for controlling the operation of the print head based on an image data when the print head is dismounted from the carriage.

In the above-described image forming apparatus, when the print head is mounted on the carriage, the apparatus functions as a normal printing apparatus for printing images on print media fed by the feeder. When, on the other hand, the print head is dismounted from the carriage, the print head can be used as a manually movable printing device whereby an image can be formed on a print object that is too thick and/or stiff to be fed by the feeding mechanism. Thus, by using the image forming apparatus according to the present invention, it is no longer necessary to purchase both the normal image forming apparatus and the manually movable image forming apparatus.

In a preferable mode of the invention, the image forming apparatus further includes a guide for guiding the print head in the main scanning direction on the surface of the print object when the print head is dismounted from the carriage and moved manually. By using the guide, an erroneous displacement of the print head in the direction vertical to the movement of the print head is prevented, so that the accuracy of printing is improved.

In the above mode of the invention, it is preferable to provide the guide with timing markers and to provide the print head with a marker-reader for reading the timing markers on the guide. In this case, it is further preferable to provide the apparatus with a position determiner for determining the position of the print head on the surface of the print object based on the output of the marker-reader when the print head is moved along the guide.

In the above-described image forming apparatus, while the print head is moved along the guide in the main scanning direction, the marker-reader reads each of the timing markers and generates a timing signal, and the timing of forming the image on the print object is determined based on the timing signal. So, even when the moving speed of the print head is uneven, a correct image is printed on the print object with ease.

The above-described apparatus may further include a memory for storing data of an image to be printed, an image size determiner for determining the width of the image based on the data stored in the memory, and an alerting mechanism for alerting the user when the print head reaches the end of the width of the image. According to such constitution, the alerting mechanism alerts the user to the completion of the printing automatically. Thus, an unnecessary movement of the print head after the completion of printing is prevented.

In the above-described image forming apparatus, it is preferable to provide a pre-scan switch for selecting a normal scan mode or a pre-scan mode when the print head is dismounted from the carriage, and to constitute the remote controller so that it calculates the amount of movement of the print head based on the output of the marker-reader of the print head and generates an image end signal when the amount of movement reaches the size of the image in the main scanning direction.

In the above-described image forming apparatus, when the user moves the print head manually in the main scanning direction with the pre-scan switch being pressed, the remote controller generates the image end signal when the amount of movement reaches the size of the image in the main scanning direction. By this pre-scanning, the user can check the position and range of the image to be printed without actually printing the image on the print object, which avoids wastes of print object due to improper printings inherent when using a conventional type of manually movable image forming apparatus. No additional hardware change is required for embodying the present mode of the apparatus, because the marker reader and the timing markers are utilized also for the pre-scanning.

When an ink jet type of print head is used in the inventive image forming apparatus, it is preferable to provide a spacing structure to the guide for defining a gap between the surface of the print object and an ink projection face of the print head set in the guide.

When the ink jet type of print head contacts with the surface of the print object, the print image becomes stained. So, it is impossible to use an ink jet type of print head in conventional types of manually movable image forming apparatuses because they are constituted so that the print head contacts with the surface of the print object. In the above-described image forming apparatus, on the other hand, the guide is utilized for holding the ink jet type of print head so that an appropriate gap is formed between the surface of the print object and the ink projection face of the print head. Thus employing the ink jet type of print head in the inventive image forming apparatus, high quality color printing is obtained even in the manual printing.

In still another preferable mode, the image forming apparatus further includes a print mode switch for selecting a normal print mode wherein an image is printed on a print medium with the print head mounted on the carriage or a manual print mode wherein an image is printed on a print object with the print head dismounted from the carriage. This mode of image forming apparatus may preferably include a maintenance mechanism provided in the body case for maintaining the print head in good condition and, a maintenance operation is carried out to the print head first when the manual print mode is selected. It is further preferable to convey the carriage to a position where the print head can be dismounted after the maintenance operation.

In the above-described mode of the apparatus, the steps of carrying out the maintenance operation to the print head and conveying the carriage to the position where the print head can be dismounted, are carried out automatically, so that not only high quality of manual printing is assured because the maintenance operation is carried out every time the manual print mode is selected, but also the user can dismount the print head from the carriage easily and quickly.

In the above-described mode, the image forming apparatus may preferably include a head detector for detecting whether the print head is mounted on the carriage, and the maintenance mechanism carries out a maintenance operation again when the print head is not dismounted from the carriage within a preset time period after the last maintenance operation.

In still another preferable mode, the image forming apparatus includes a head detector for detecting whether the print head is mounted on the carriage and an alerting mechanism for alerting the user when a preset time lapses after dismounting the print head.

In the above-described mode of the apparatus, such an erroneous operation where the normal printing is carried out though the print head is dismounted from the carriage, is prevented by checking the output of the head detector. Further, when the print head is an ink jet type, for example, such trouble as that of the ink projection face of the print head being clogged by dried ink as a result of leaving the print head dismounted for a long time, can be avoided because the alerting mechanism alerts the user when the preset time lapses after the print head is dismounted.

BRIEF DESCRIPTION OF THE DRAWINGS

A preferred embodiment of the image forming apparatus according to the invention is described below, referring to the attached drawing wherein.

DETAILED DESCRIPTION OF A PREFERRED EMBODIMENT

Figure 1:
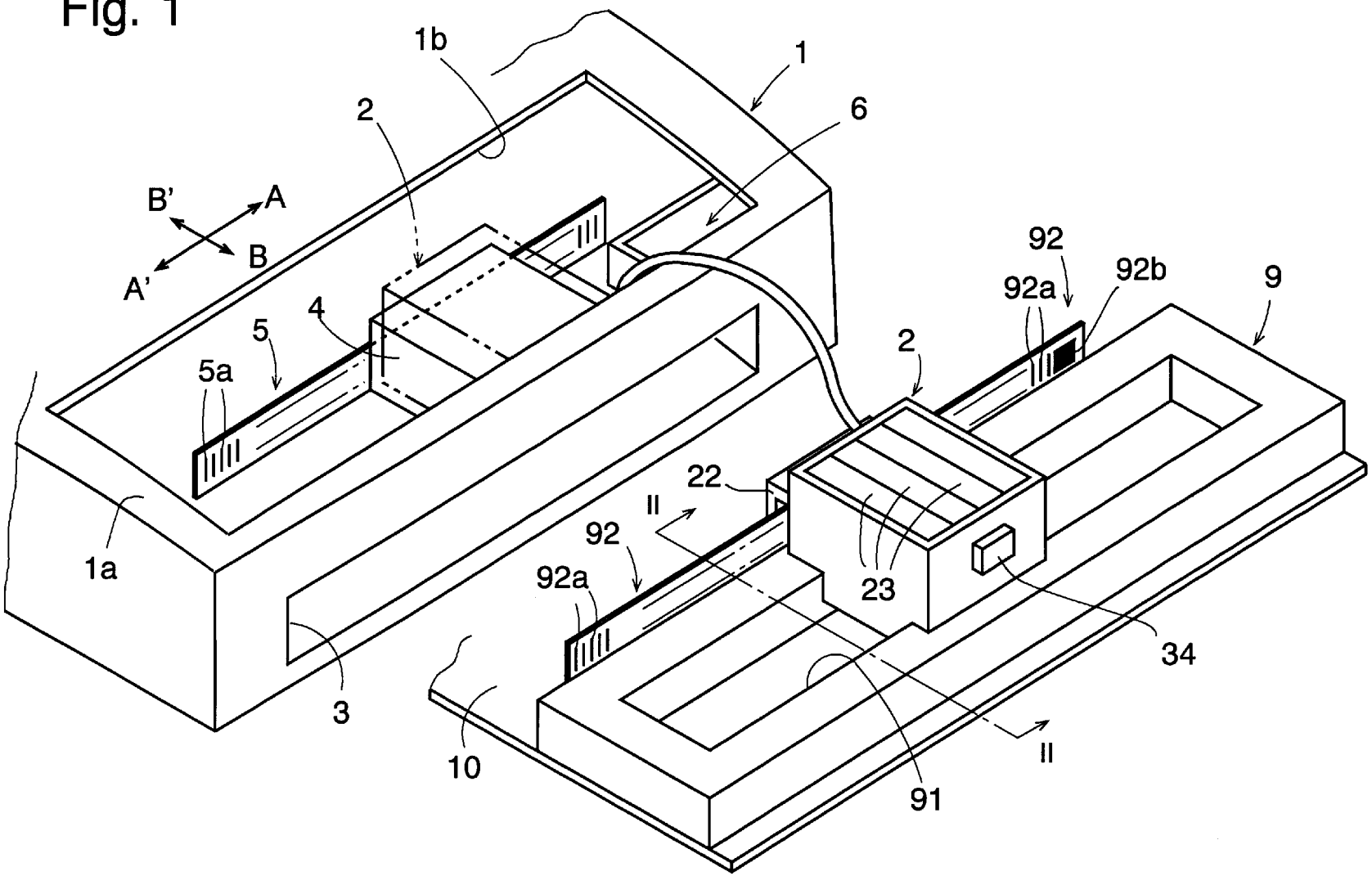
FIG. 1 is a perspective view of the image forming apparatus.

The constitution of an image forming apparatus embodying the present invention, which is referred to as "printer 1" hereinafter, is described referring to FIGS. 1–4. The printer 1 has a body case 1*a* with an opening 1*b* at its top and, though not shown in FIG. 1, a paper feeder is provided at the rear part of the body case 1*a*. The paper feeder includes: a stacking unit for holding a stack of paper (or other print medium) of the same size inside; and an automatic feeding mechanism for feeding the paper, one sheet after another, into a feed path in the body case 1*a*. In the feed path is disposed a carriage 4 for mounting a print head 2. The print head 2 is ink jet type having an ink projection face 2*b* at its bottom (see FIG. 3). The ink projection face 2*b* has four nozzles corresponding to four colors of black, cyan, magenta and yellow, so that color printing is achievable, if desired. Four ink cartridges 23 corresponding to the four colors are detachably provided at the top of the print head 2, so that any color of ink can be replenished when necessary.

A carriage driver (not shown) including a driving motor and a transmission mechanism is provided in the body case 1*a,* whereby the carriage 4 is driven to travel back and forth in a main scanning direction (denoted by line A–A' in FIG. 1), which is vertical to the direction of feeding the paper (i.e. the subscanning direction denoted by line B–B').

In the printer 1, automatic printing (or normal printing) using the paper feeder is carried out as follows, with the print head 2 mounted on the carriage 4. The paper is fed from the paper feeder past the ink projection face 2*b* of the print head 2 mounted on the carriage 4, and the carriage 4 is driven by the carriage driver back and forth in the main scanning direction. Meanwhile, the print head 2 is driven by a central control unit (CPU) 30 in FIG. 4 so that bubbles of ink are projected from the ink projection face 2*b* to the paper according to a dot pattern determined in the image data. After the image is completely printed on the paper, the paper is fed out of the body case 1*a* through a paper outlet 3 provided at the front of the body case 1*a*.

Figure 2:
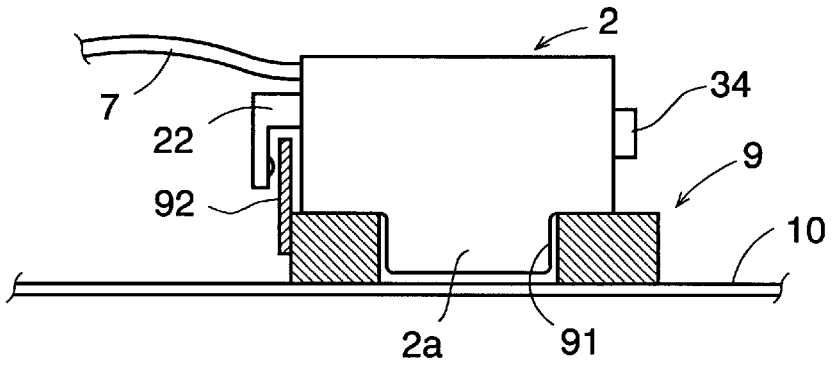
FIG. 2 is a cross sectional view of a guide at line II—II in FIG. 1.
Figure 3:
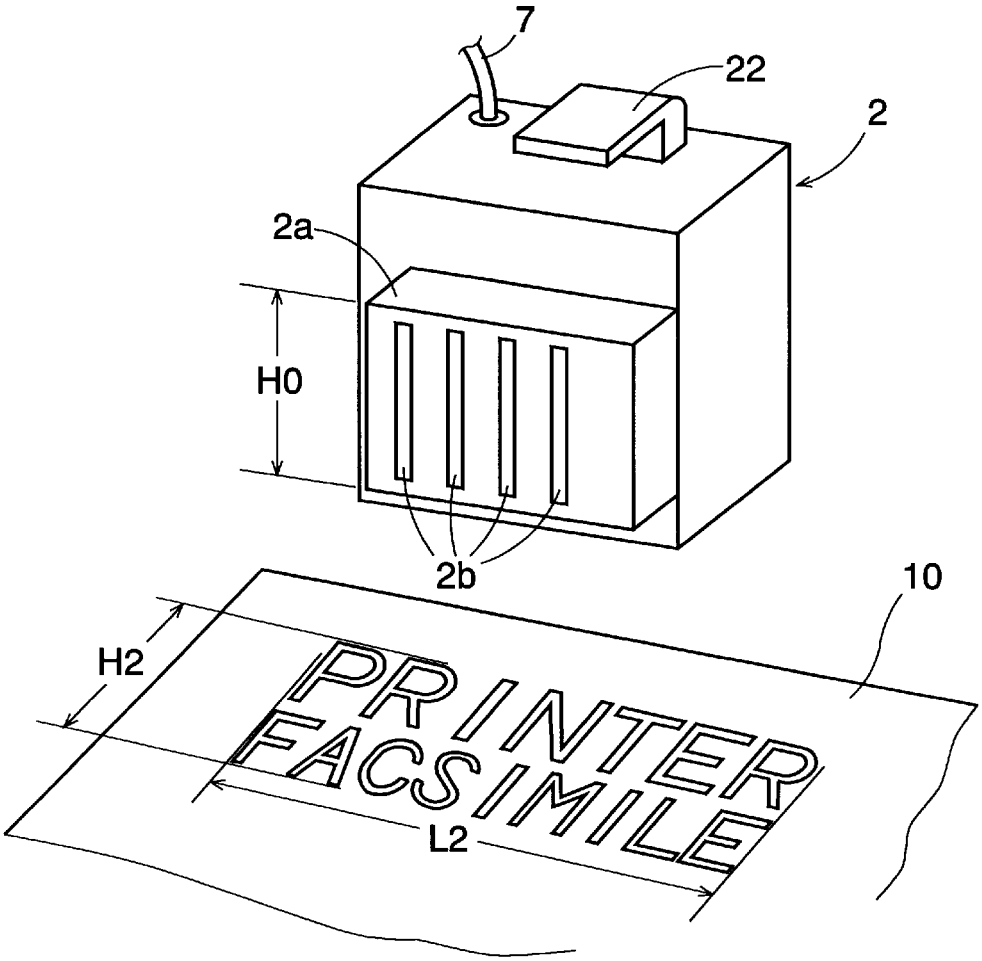
FIG. 3 is a perspective view showing a print head and an image on a print medium.

In the printer 1, when the print head 2 is mounted on the carriage 4, a head part 2*a* including the ink projection face 2*b* comes to the bottom of the print head 2, and the image is printed on the top of the paper fed beneath the head part 2*a* (see FIG. 2). As shown in FIG. 1, a longitudinal timing fence 5 is disposed in the body case 1*a,* parallel to the path of the carriage 4 (i.e. parallel to the main scanning direction). The timing fence 5 is a transparent plate, for example, made of synthetic resin having timing markers 5*a* of a preset pitch. The timing fence 5 constitutes a timing signal generator in association with a marker-reader 22 provided to the print head 2. The marker-reader 22 is constituted using a transmission type of photosensor provided to a side of the print head 2, for example.

The timing signal generator generates timing signals for taking the timing of printing while the print head 2 is traveling in the main scanning direction. In detail, during the travel of the print head 2 in the main scanning direction, the marker-reader 22 of the print head 2 optically detects each of the timing markers 5*a* and generates a timing signal for each marker. The CPU 30 in FIG. 4 detects the direction and amount of movement of the print head 2 in the main scanning direction based on the timing signals.

In the body case 1*a,* a maintenance unit 6 is provided at an end of the travel path of the carriage 4. The maintenance unit 6 includes a vacuum mechanism, a wiping mechanism and a brushing mechanism, and removes contaminants from the ink projection face 2*b* of the print head 2 by a process including steps of: posing the print head 2 at the end of the travel path; contacting a vacuum mechanism with the ink projection face 2*b* and sucking ink therefrom; wiping ink remaining on the ink projection face 2*b* with the wiping mechanism after the step of sucking the ink; and ejecting ink forcefully out of all the nozzles of the print head 2 with the brushing mechanism.

The print head 2 is connected with the CPU 30 of the printer 1 (see FIG. 4) via a cable 7 and a bus (not shown). The CPU 30 sends image data, control signals, etc., to the print head 2 through the bus and the cable 7. The cable 7 is also used for supplying electric power from a power source (not shown) to the print head 2.

The printer 1 is equipped with a guide 9 having a longitudinal opening 91 and a timing fence 92. The print head 2 is mounted across the width of the opening 91 and movable along the length of the opening. The depth of the opening 91 is defined so that the ink projection face 2*b* of the print head 2 faces the top of the print object 10 with a small gap (see FIG. 2). The timing fence 92 is a longitudinal plate extending parallel to the length of the opening 91 or the main scanning direction. The timing fence 92 has timing markers 92*a*, as those on the timing fence 5, and constitutes a timing signal generator in association with the marker-reader 22 of the print head 2.

Using the guide 9, the manual printing is carried out in the following manner. First, the guide 9 is placed on a print object 10 so that the length of opening 91 extends parallel to the scanning direction or the direction in which the print head 2 is to be moved. The print head 2 is dismounted from the carriage 4 through the opening lb of the body case 1*a,* and is set on the opening 91 of the guide 9 with the head part 2*a* downwards and the timing fence 92 inserted in the marker-reader 22, as shown in FIGS. 1 and 2. Then, the print head 2 is moved manually along the opening 91. The CPU 30 in FIG. 4 detects the direction and amount of the movement of the print head 2 along the opening 91, based on the detection of the timing signals.

The print head 2 has a driving circuit (not shown) inside, which controls the projection of ink from the ink projection face 2*b* according to the control signals from the CPU 30 of the printer 1. Further, the print head 2 has a switch 34 used for carrying out pre-scanning which will be explained later.

Figure 4:
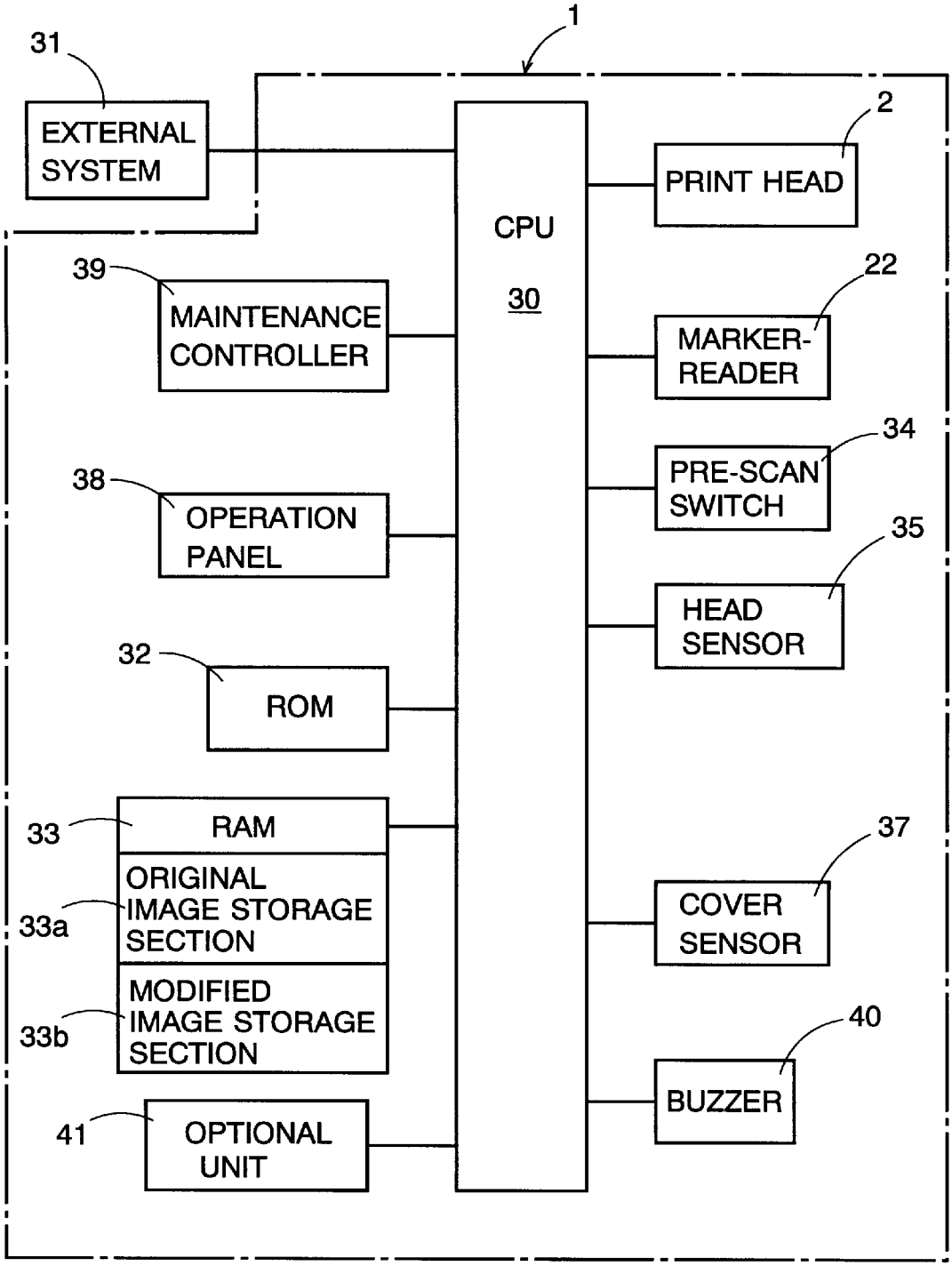
FIG. 4 is a block diagram showing the functional constitution of the image forming apparatus.

FIG. 4 is a block diagram showing the functional constitution of the printer 1. The printer 1 includes: the central processing unit (CPU) 30 for controlling the other parts of the printer 1 according to preset programs; a read only memory (ROM) 32 wherein the programs are stored beforehand; and a random access memory (RAM) 33 for temporarily storing various data during the operation. Data of the image (characters, graphics, etc.) to be printed is transferred from an external system 31 (e.g. a personal computer) to the CPU 30, and is stored in the RAM 33 temporarily.

The RAM 33 has an original image storage section 33a for storing an original image data or the image data given from the external system 31, and a modified image storage section 33*b* for storing a modified image data derived from the original image data by a process explained later. The two sections 33*a* and 33*b* are referred to as the OID storage section 33*a* and the MID storage section 33*b* hereinafter. An optional unit 41 is connected to CPU 30 for allowing the user to select whether an automatic resizing function, which will be explained later, is used. The optional unit 41 is constituted by an electrically erasable programmable read only memory (EEPROM) and other elements, for example.

In addition to the print head 2, the marker-reader 22 and the pre-scan switch 34, the CPU 30 is connected to the following elements; a head sensor 35 provided to the carriage 4 for detecting whether the print head 2 is mounted on the carriage 4; an cover sensor 37 for detecting whether a cover (not shown) to the opening 1*b* of the body case 1*a* is open; an operation panel 38 having switches and buttons for the user to control the operation of the printer 1; a maintenance controller 39 for controlling the operation of the maintenance unit 6; and a buzzer 40 for alerting the user.

Figure 5:
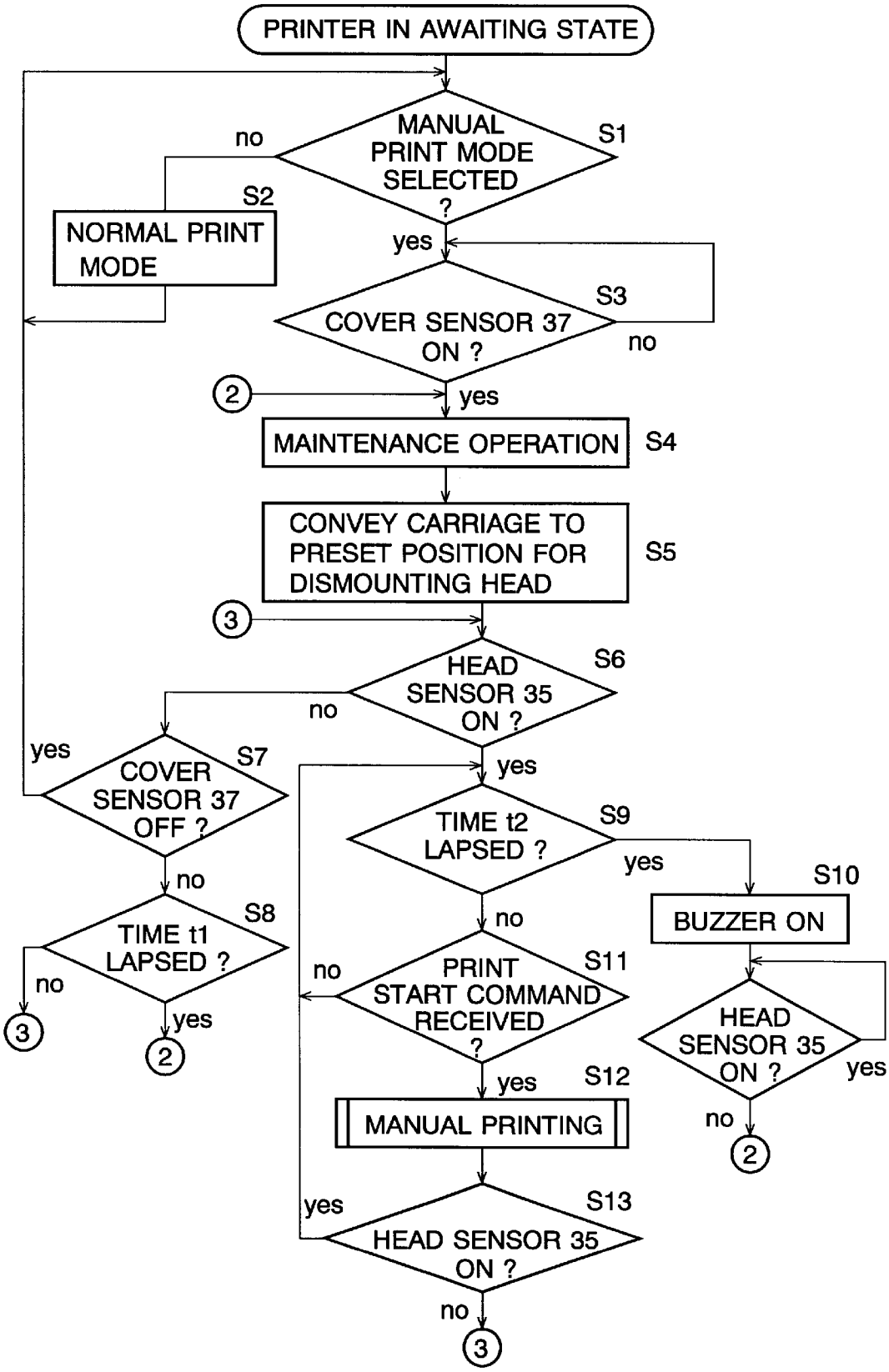
FIG. 5 is a flow chart showing a process of controlling the printing operation.

FIG. 5 is a flow chart showing an example of the control process for selecting a normal print mode for carrying out the normal printing or a manual print mode for carrying out the manual printing.

When the user produces an image of characters or graphics using a keyboard, a scanner, etc., the data of the image is stored in the external system 31. When the user orders the external system 31 to start printing, the external system 31 transfers the image data to the RAM 33 of the printer 1. While the data is being transferred, or after the data transfer is completed, the printer 1 is in an awaiting state. When the user operates the operation panel 38 of the printer 1 or an input device of the external system 31 to send a print mode designating signal to the CPU 30, the CPU 30 determines based on the signals whether the manual print mode is selected (Step S1). When the manual print mode is not selected (Step Si: no), the printing is carried out in the normal print mode (Step S2). That is, the image is printed on a sheet of paper by feeding the paper into the feed path in the body case 1*a* and driving the carriage 4 with the print head 2 back and forth on the paper.

When the manual print mode is selected (Step S1: yes), the operation proceeds to Step S3 where the CPU 30 determines based on the output of the cover sensor 37 whether the cover of the opening 1*b* is open. The operation is suspended at Step S2 while the output of the cover sensor 37 turns OFF, i.e. while the opening 1*b* is closed (Step S3: no).

When the determination result in Step S3 is "yes", the carriage driver and the maintenance controller 39 are controlled so that the carriage 4 is conveyed to the maintenance unit 6 and the maintenance operation is carried out to the print head 2 (Step S4). After the maintenance operation, the carriage 4 is conveyed to a position where the print head 2 can be mounted on or dismounted from the carriage 4 (Step S5). At the position, the user can mount the print head 2 on or dismount the print head 2 from the carriage 4 through the opening 1*b* with ease.

In Step S6, the CPU 30 monitors the output of the head sensor 35 to determine whether the print head 2 is dismounted from the carriage 4. When the output of the head sensor 35 is OFF (Step S6: no), meaning that the print head 2 is still mounted on the carriage 4, the operation proceeds to Step S7, where the CPU 30 determines whether the output of the cover sensor 37 is OFF to determine whether the opening 1*b* is closed again by the cover. When it is determined that the opening 1*b* is closed again by the cover (S7: yes), the operation goes back to step S1.

When the output of the cover sensor 37 is ON, i.e. when the cover of the opening 1*b* is open (S7: no), the CPU 30 determines whether the lapse of time from the completion of the last maintenance operation is greater than a preset time length t1[sec] (Step S8). When the lapse of time is greater than t1[sec] (Step S8: yes), the operation returns to Step S4 to carry out the maintenance operation again, because it is probable that the ink projection face 2*b* of the print head 2 is dry. When the lapse of time is not greater tl[sec] (Step S8: no), the operation returns to Step S6 to further await the dismounting of the print head 2.

When the output of the head sensor 35 is ON (Step S6: yes), the CPU 30 determines whether the lapse of time from the completion of the last maintenance operation is greater than another preset time length t2[sec] (Step S9). When the lapse of time is greater than t2[sec] (Step S9: yes), the CPU 30 energizes the buzzer 40 to alert the user (Step S10), because it is probable that the ink on the ink projection face 2*b* of the print head 2 becomes dry when the dismounted print head 2 is left unused for a long time. Accordingly, the buzzer 40 is energized as described above to urge the user to mount the print head 2 on the carriage 4 and carry out the maintenance operation.

When the lapse of time is not greater than t2 (Step S9: no), the CPU 30 determines whether a start command of the manual printing is received from the operation panel 38 (Step S11). When the command signal is received (Step S11: yes), the manual printing is carried out (Step S12), which will be explained later. After that, the CPU 30 determines whether the output of the head sensor 35 is ON (Step S13). When the output of the head sensor 35 is OFF (Step S13: no), it means that the user has returned the print head 2 to the carriage 4. When, on the other hand, the output of the head sensor 35 is ON, it means that the manual printing is still underway.

Figure 6:
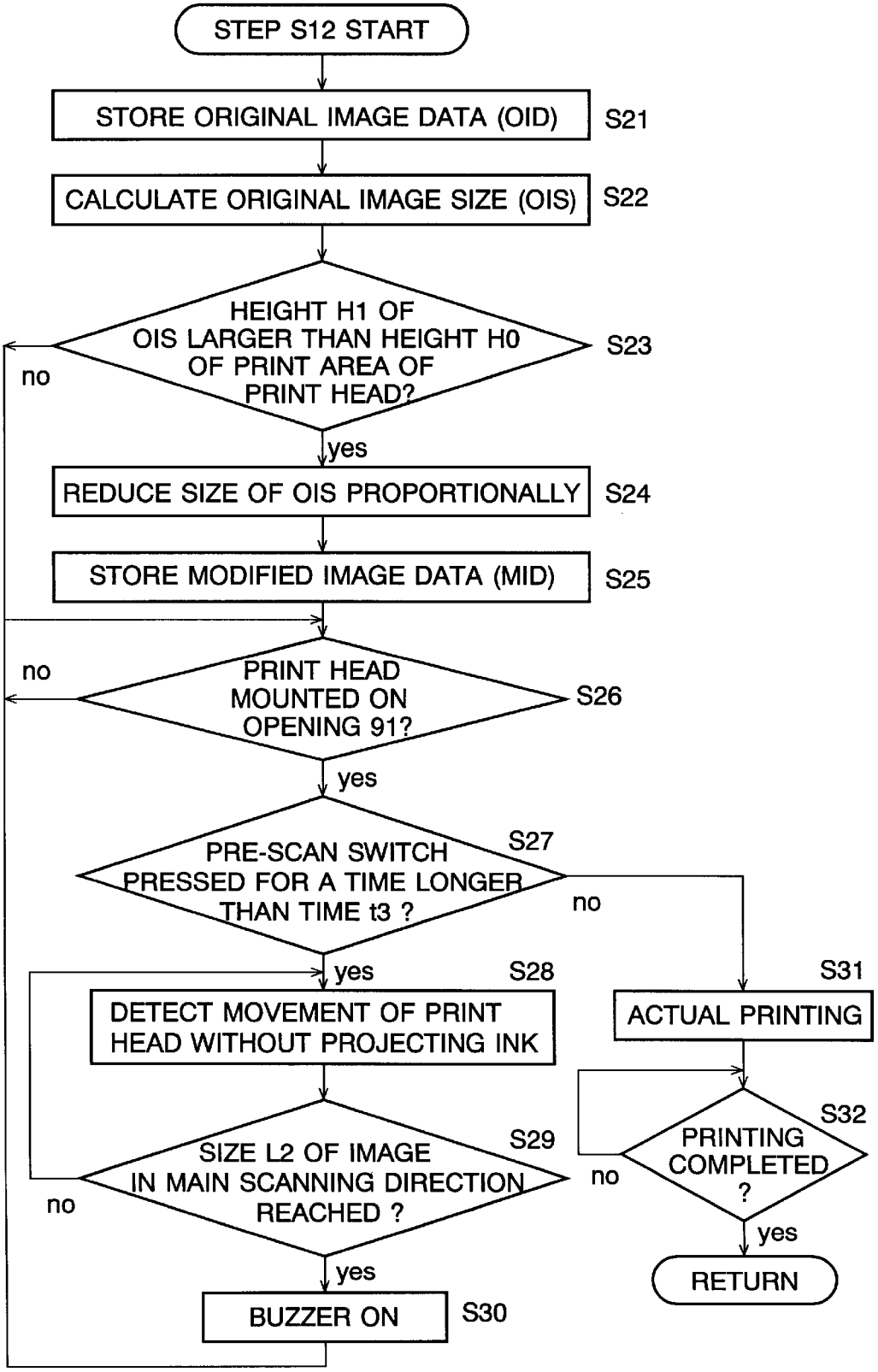
FIG. 6 is a flow chart showing a subroutine of a manual print mode.

The control process of forming an image on the print object 10 in the manual print mode is explained now, referring to the subroutine flow chart of FIG. 6. In the following description, it is assumed that the automatic resizing function is selected in the optional unit 41 by the user through the operation panel 38 or the external system 31.

At the beginning of the manual printing subroutine (Step S12), the image data given from the external system 31 is stored in the OID storage section 33*a* as the original image data (Step S21). Next, the CPU 30 reads out the original image data from the OID storage section 33*a,* and calculates the size of the original image (OIS) (Step S22). The original image size includes the height Hi of the original image measured in the subscanning direction of the print head 2. In Step S23, the CPU 30 determines whether the height H1 of the original image is larger than the height HO of the printing area of the print head 2.

When H1>HO (Step S23: yes), the complete image of the characters, graphics, etc., cannot be printed by a single scanning of the print head 2 along the main scanning direction, if the original image data stored in the OID storage section 33*a* is used as it is. That is, part of the print image will be missing in the upper or lower end of the image, or both.

So, when the determination result in Step S23 is "yes", the CPU 30 carries out a modification calculation, whereby the height and width of the original image size (OIS) is changed proportionally to a reduced size whose height H2 is equal to or smaller than the height HO of the printing area (Step S24). The data of the reduced image size, or the modified image data, is stored in the ND storage section 33*b* (Step S25).

After that, the CPU 30 determines whether the head part 2*a* of the print head 2 is set in the opening 91 of the guide 9 (Step S26). In detail, when the user mounts the print head 2 on the opening 91 at the end where a photo-interrupter 92*b* of the timing fence 92 stands, the output of the marker-reader 22 turns OFF. Based on the change in the output of the marker-reader 22, the CPU 30 determines that the head part 2*a* of the print head 2 is set in the opening 91. The determination result in Step S26 being "yes", the operation proceeds to Step S27 where the CPU 30 determines whether the pre-scan switch 34 is pressed for a time period longer than a preset period t3[sec]. When the determination result in Step S27 is "yes", a pre-scanning is carried out through Steps S28–S30.

The purpose of the pre-scanning is to check the position and range of the image to be printed in the main scanning direction before actually printing the image. In the pre-scanning, the user mounts the print head 2 on the opening 91 of the guide 9 with the timing fence 92 inserted into the marker-reader 22 of the print head 2. Pressing the pre-scan switch 34, the user moves the print head 2 from the start point of printing along the opening 91, meanwhile the marker-reader 22 detects each of the timing markers 92*a* and generates a timing signal. The CPU 30 detects the amount of movement of the print head 2 based on the output of the marker-reader 22 without projecting ink to the print object 10 (Step S28), and determines whether the amount of movement of the print head 2 reaches the size L2 of the print image in the main scanning direction (see FIG. 3). When the determination result in Step S29 is "yes", i.e. when the print head 2 is at or past the end of the image to be printed, the buzzer 40 in the printer 1 is energized for alerting the user to the fact that the print head 2 has reached the end of the image to be printed (Step S30).

Thus, the user can check the position and range of the image in the main scanning direction by carrying out the pre-scanning, and waste of print media due to improper printings can be avoided. Another advantage is that, even when the print medium has a small or limited print area, such as a label, the image can be printed within the given area assuredly by carrying out the pre-scanning.

After checking the position and range of the image to be printed on the print object 10, an actual printing is carried out as follows. When the user returns the head part 2*a* of the print head 2 to the start point of printing, the CPU 30 detects the setting of the head 2 in the guide 9 based on the output of the marker-reader 22 (Step S26: yes). This time, the user does not press the pre-scan switch 34, so that the determination result in Step S27 is "no". Accordingly, the operation proceeds to Step S31 where the actual printing is carried out. In the actual printing, the complete image having the size of the modified image data is printed on the print object 10 by simply moving the print head 2 along the opening 91. Since the timing of projecting ink from the ink projection face 2*b* of the head part 2*a* is determined based on the timing of detecting the timing markers 92*a* on the timing fence 92 as described above, the image is printed correctly even when the moving speed of the print head 2 is uneven.

In the above-described printer 1, the optional unit 41 may be constituted so that the user can select whether the automatic resizing function is extended to an enlargement of the original image. That is, when the original image size (OIS) in the subscanning direction (i.e. the height H1) is too small compared to the height H0 of the print area of the print head 2, a modification calculation for enlarging the image size is carried out. For example, when it is determined in Step S23 that $H1<(1/3)*H0$, the CPU 30 carries out a modification calculation whereby the height and width of the original image size (OIS) is changed proportionally so that the height is almost equal to the height H0 of the printing area (Step S24). Further, it is preferable to constitute the optional unit 41 so that the user can preset a desired image height to be obtained by the modification calculation.

It should be easily understood that original image data (OID can be used for the actual printing on the print object 10 without any modification when the size of the original image is appropriate.

In the above-described embodiment, the cable 7 is used to transfer the original image data and to supply the electric power from the main body of printer 1 to the print head 2. In a preferable modification of the printer 1, a battery is provided in the print head 2, and a wireless communication system such as an infrared communication system, for example, is provided in the print head 2 and the printer 1. With the wireless communication system for sending image data and control signals to the print head 2, the user can operate the printer 1 or carry out the maintenance work to the printer 1 conveniently and easily since the cable 7 is not used. Particularly, the operation with the print head 2 dismounted from the carriage 4 is significantly facilitated.

What is claimed is:

1. An image forming apparatus, comprising:

a print head for forming an image on a surface of an object;

a carriage for mounting the print head in a body case, where the print head is dismountable from the carriage;

a feeder for feeding a print medium in a feeding direction;

a carriage driver for driving the carriage in a main scanning direction which is vertical to the feeding direction so that the carriage scans the surface of the print medium; and a remote controller provided in the body case for controlling the operation of the print head based on an image data when the print head is dismounted from the carriage.

2. The apparatus according to claim 1, comprising a guide for guiding the print head in the main scanning direction on a surface of a print object when the print head is dismounted from the carriage and moved manually.

3. The apparatus according to claim 2, wherein the guide includes timing markers and the print head includes a marker-reader for reading the timing markers on the guide.

4. The apparatus according to claim 3, comprising a position determiner for determining a position of the print head on the surface of the print object based on the output of the marker-reader when the print head is moved along the guide.

5. The apparatus according to claim 4, comprising a memory for storing data of an image to be printed, an image size determiner for determining a width of the image based on the data stored in the memory, and an alerting mechanism for alerting a user when the print head reaches an end of the width of the image during movement of the print head on the surface of the print object.

6. The apparatus according to claim 2, wherein the print head is an ink jet type of print head, and the guide is provided with a spacing structure for forming a gap between the surface of the print object and an ink projection face of the print head set in the guide.

7. The apparatus according to claim 1, comprising a print mode switch for selecting a normal print mode wherein an image is printed on a print medium with the print head mounted on the carriage or a manual print mode wherein an image is printed on a print object with the print head dismounted from the carriage.

8. The apparatus according to claim 7, comprising a maintenance mechanism provided in the body case for maintaining the print head in good condition, wherein a maintenance operation is carried out to the print head first when the manual print mode is selected.

9. The apparatus according to claim 8, wherein the carriage is conveyed to a position where the print head can be dismounted after the maintenance operation.

10. The apparatus according to claim 9, comprising a head detector for detecting whether the print head is mounted on the carriage, and the maintenance mechanism carries out a maintenance operation again when the print head is not dismounted from the carriage within a preset time period after the last maintenance operation.

11. The apparatus according to claim 1, comprising a head detector for detecting whether the print head is mounted on the carriage and an alerting mechanism for alerting a user when a preset time lapses after dismounting the print head.

12. An image forming apparatus, comprising:

a print head for forming an image on a surface of an object;

a carriage for mounting the print head in a body case, where the print head is dismountable from the carriage;

feeding means for feeding a print medium in a feeding direction;

carriage driving means for driving the carriage in a main scanning direction which is vertical to the feeding direction so that the carriage scans the surface of the print medium; and remote control means provided in the body case for controlling the operation of the print head based on an image data when the print head is dismounted from the carriage.

13. The apparatus according to claim 12, comprising guiding means for guiding the print head in the main scanning direction on a surface of a print object when the print head is dismounted from the carriage and moved manually.

14. The apparatus according to claim 13, wherein the guiding means includes timing markers and the print head includes a marker-reader for reading the timing markers on the guide.

15. The apparatus according to claim 14, comprising position determining means for determining a position of the print head on the surface of the print object based on the output of the marker-reader when the print head is moved along the guide.

16. The apparatus according to claim 15, comprising memory means for storing data of an image to be printed, image size determining means for determining a width of the image based on the data stored in the memory means, and alerting means for alerting a user when the print head reaches an end of the width of the image during movement of the print head on the surface of the print object.

17. The apparatus according to claim 13, wherein the print head is an ink jet type of print head, and the guiding means is provided with spacing means for forming a gap between the surface of the print object and an ink projection face of the print head set in the guiding means.

18. The apparatus according to claim 12, comprising print mode selecting means for selecting a normal print mode wherein an image is printed on a print medium with the print head mounted on the carriage or a manual print mode wherein an image is printed on a print object with the print head dismounted from the carriage.

19. The apparatus according to claim 18, comprising maintenance means provided in the body case for maintaining the print head in good condition, wherein a maintenance operation is carried out to the print head first when the manual print mode is selected.

20. The apparatus according to claim 19, wherein the carriage is conveyed to a position where the print head can be dismounted after the maintenance operation.

21. The apparatus according to claim 20, comprising head detecting means for detecting whether the print head is mounted on the carriage, and the maintenance mechanism carries out a maintenance operation again when the print head is not dismounted from the carriage within a preset time period after the last maintenance operation.

22. The apparatus according to claim 12, comprising head detecting means for detecting whether the print head is mounted on the carriage and alerting means for alerting a user when a preset time lapses after dismounting the print head.

* * * * *